United States Patent [19]

Evangelist et al.

[11] Patent Number: 4,895,283

[45] Date of Patent: Jan. 23, 1990

[54] ADJUSTABLE GARMENT HANGER

[76] Inventors: Louis W. Evangelist, 1009 Black Oak Cir., Fairfield Glade, Tenn. 38555; Robert Yanarella, 38555 St. George Dr., Fairfield Glade, Tenn. 38575

[21] Appl. No.: 257,930

[22] Filed: Oct. 14, 1988

[51] Int. Cl.[4] ..... A47G 25/44

[52] U.S. Cl. ..... 223/94

[58] Field of Search ..... 223/89, 90, 94

[56] References Cited

U.S. PATENT DOCUMENTS

| | | | |
|---|---|---|---|
| 765,331 | 7/1904 | Batts . | |
| 2,494,711 | 1/1950 | Kusher et al. . | |
| 2,652,958 | 9/1953 | Alvord . | |
| 2,754,039 | 7/1956 | Pierce . | |
| 2,900,117 | 8/1959 | Veltry | 223/94 |

FOREIGN PATENT DOCUMENTS

| | | | |
|---|---|---|---|
| 203175 | 5/1959 | Austria | 223/89 |
| 6444731 | 6/1928 | France | 223/94 |
| 1204121 | 8/1959 | France | 223/89 |
| 1228075 | 3/1960 | France | 223/89 |
| 2586919 | 3/1987 | France | 223/89 |

*Primary Examiner*—Werner H. Schroeder

*Attorney, Agent, or Firm*—Kenyon & Kenyon

[57] ABSTRACT

An adjustable garment hanger comprises a hanger body having a central portion and two integrally formed arms depending therefrom with the central portion and arms having forwardly arched contours defining a continuous, forwardly arched contour for the hanger body, a bore formed in the central portion, a hook mounted in the bore for supporting the hanger, a plurality of notches provided in each arm and two hollow shoulder extensions having generally U-shaped cross sections with one of the shoulder extensions detachably connected to a respective arm. Each of the shoulder extensions has a forwardly arched contour that merges with the forwardly arched contour of the hanger body and a projecting tongue member received in one of the notches whereby each shoulder extension closely fits over its respective arm.

7 Claims, 8 Drawing Sheets

ADJUSTABLE GARMENT HANGER

BACKGROUND OF THE INVENTION

This invention relates generally to garment hangers and more particularly to adjustable garment hangers for supporting garments of different sizes.

Adjustable garment hangers in which the lengths of the arms may be extended or retracted to accommodate apparel of various shoulder widths are disclosed in U.S. Pat. Nos. 765,331; 2,494,711; 2,652,958; 2,754,039 and 2,900,117. Despite the advantages of adjustable garment hangers in preventing a garment from being creased or pulled out of shape under its own weight as it is supported on the hanger during manufacture, shipping or storage in a warehouse, retail store or consumer's closet, apparently none of the prior adjustable hangers are presently in widespread commercial use.

For various reasons, the prior adjustable hangers have been unable to satisfy the need for adjustable garment hangers. The two main problems with the prior devices are the complex construction requiring increased cost of production and the difficulty encountered to adjust and readjust the arms for supporting various shoulder width garments. In addition, provision of the mechanism required to adjust the length of the hanger heretofore has made it difficult to economically manufacture a hanger having a forwardly arched contour. This contour makes the hanger much more effective in preventing the shoulders and armholes from being pulled out of shape because the hanger contour conforms to the contour of most garments in which the shoulders are curved or arched forwardly.

Hence, the present invention is directed to the problem of satisfying the need for an adjustable garment hanger which avoids the aforementioned disadvantages of the prior art, yet is both simple to manufacture and use and provides excellent support for the shoulders and armholes of various sizes of garments.

SUMMARY OF THE INVENTION

The invention solves this problem by provision of an adjustable garment hanger comprising a hanger body having a central portion and two integrally formed arms depending therefrom, with the central portion and arms having forwardly arched contours defining a continuous, forwardly arched contour for the hanger body, a bore formed in the central portion, a hook mounted in the bore for supporting the hanger, a plurality of notches provided in each arm and two hollow shoulder extensions having generally U-shaped cross sections with one of the shoulder extensions detachably connected to a respective arm. Each of the shoulder extensions has a forwardly arched contour that merges with the forwardly arched contour of the hanger body and a projecting tongue member received in one of the notches whereby each shoulder extension closely fits over its respective arm. In this manner, the adjustable hanger of the invention is formed from three principal parts, i.e., the hanger body and shoulder extensions. The hanger body and shoulder extensions preferably are molded by conventional techniques from plastic as separate integral pieces. This greatly simplifies the cost and manufacture of the hanger of the invention when compared to prior adjustable hangers.

The arms may be hollow and each comprise a generally U-shaped cross section defined by a curved top wall and two substantially flat side walls downwardly depending therefrom, with the notches being formed as apertures in the curved top wall that are separated by individual arches spanning the side walls. Each projecting tongue member may comprise a first curved section connected to one of the shoulder extensions and a second substantially straight section downwardly depending from the curved section whereby each shoulder extension is detachably connected to its respective arm by inserting the second section into one of the apertures such that the second section lies underneath one of the arches and the first section lies over an adjacent arch. Each aperture has associated therewith a visible symbol representative of a predetermined garment size whereby the shoulder extensions may be detachably connected to the arms in positions corresponding to predetermined garment sizes. In this manner, the hanger of the invention is more easily and quickly adjusted than the adjustable hangers of the prior art.

The shoulder extensions may be integrally formed with bulbous end portions to provide increased support for the shoulders and armholes of the garment than heretofore achieved in prior adjustable hangers. The bulbous end portions fit into the armholes and support the shoulders of the garment to prevent caving-in of the armholes and creasing or distortion of the garment.

DETAILED DESCRIPTION

Figure 1:
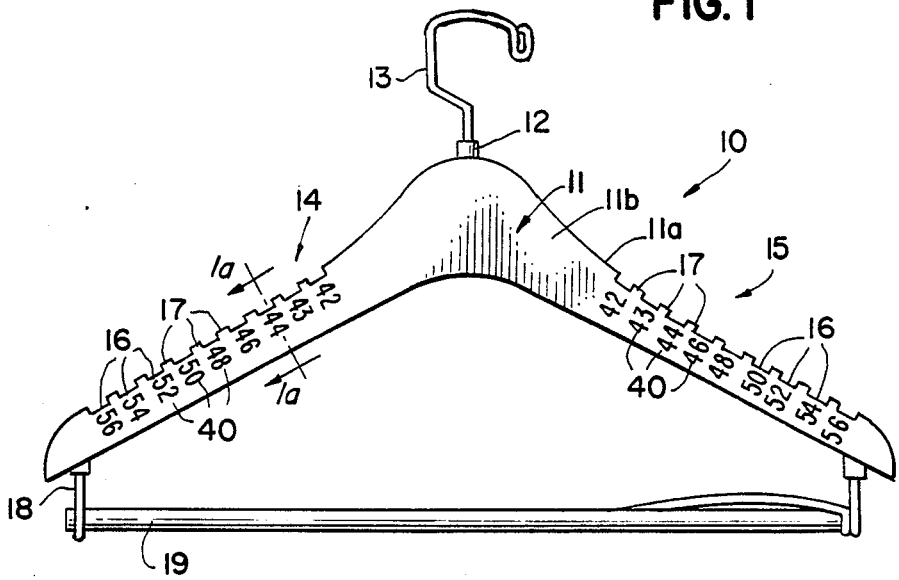
FIG. 1 is a front plan view of an adjustable garment hanger body, shown lying on a horizontal surface, constructed according to the principles of the invention.
Figure 2:
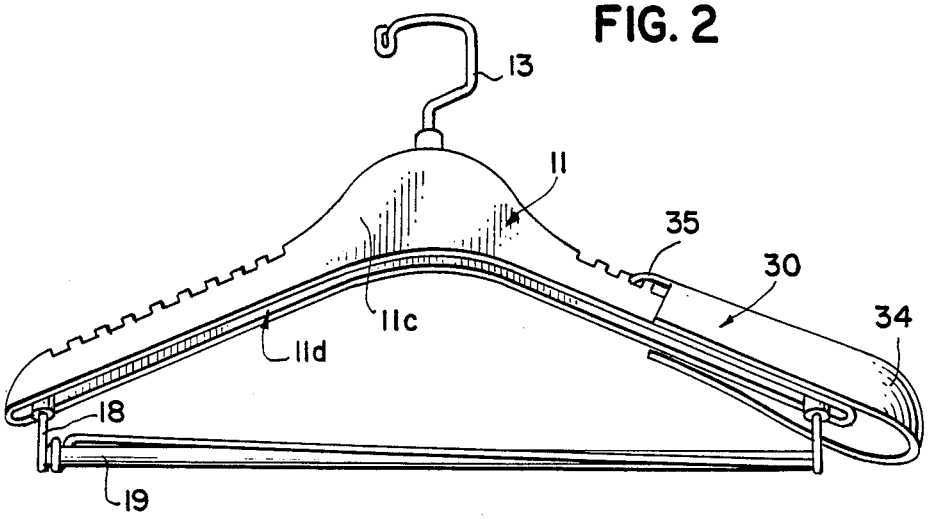
FIG. 2 shows a back perspective view of the adjustable garment hanger body with a bulbous end-type shoulder extension connected to one arm.

FIG. 1 illustrates the hanger body 10 of an adjustable garment hanger of the invention. Hanger body 10 comprises a single molded plastic part which is made up of a central portion 11 and two downwardly depending arms 14 and 15 integrally molded therewith. Hanger body 10 has a continuous, forwardly arched or curved shape to conform with the corresponding shape of most garments, i.e., overcoats, suits, jackets, etc. This shape can best be seen from the illustration of FIG. 2 which shows a back view of hanger body 10. In order to achieve this shape, arms 14 and 15 continuously and gradually arch forwardly out of the plane of the paper, as viewed in FIG. 1. Furthermore, the shoulder extensions are provided with a similar contour, as subsequently discussed.

Figure 1A:
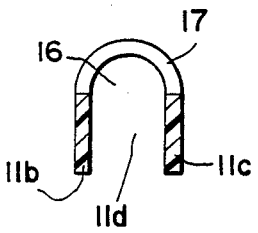
FIG. 1*a* is a cross sectional view along lines 1—1 of FIG. 1 illustrating the generally U-shaped cross section of the hanger body of the invention.

A central boss 12 defines a bore therethrough in which hook 13 is mounted for supporting the hanger in a manner well known in the art. Hanger body 10 is generally U-shaped in cross section to define a hollow interior 11*d* as shown in FIG. 1*a*. This cross section is defined by the curved top wall 11*a* which is integrally formed with downwardly projecting, substantially flat, side walls 11*b* and 11*c*. Arms 14 and 15 are formed with a plurality of notches 16 defined between arches 17 of top wall 11*a* that open into the hollow interior 11*d*. The arches 17 span across side walls 11*b* and 11*c*. Notches 16 define apertures through which the shoulder extensions are detachably connected to arms 14, 15.

Hanger body 10 may be provided with a wire bar 18 extending between arms 14 and 15 having distal ends connected to bosses integrally formed within arms 14 and 15, respectively. A wooden dowel 19 is fixedly connected to one end of bar 18 in a manner well known in the art for supporting slacks, or the like.

Figure 3:
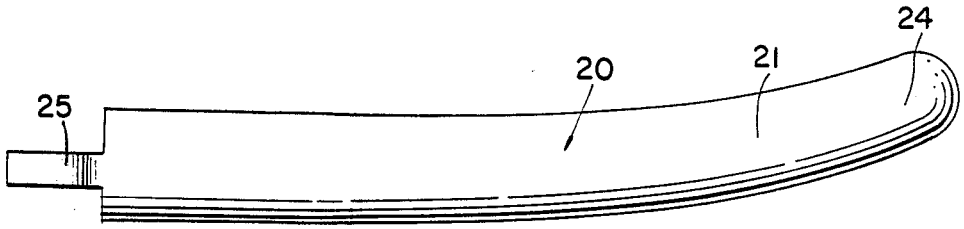
FIGS. 3 and 3*a*, respectively, are top plan views of shoulder extensions constructed according to the principles of the invention.
Figure 3A:
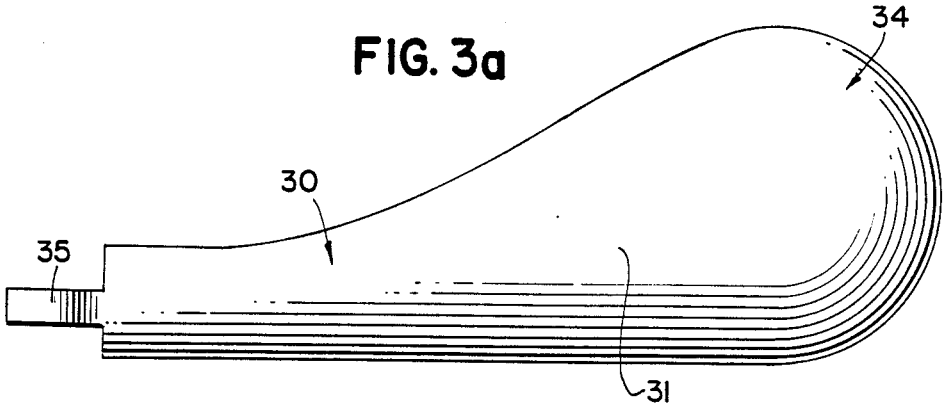
Figure 4:
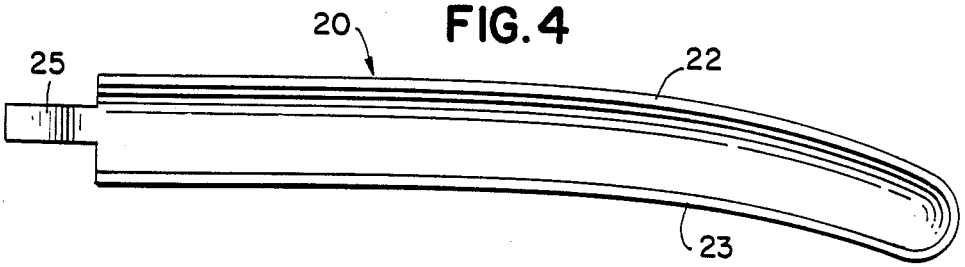
FIGS. 4 and 4*a* are bottom plan views of the shoulder extensions shown in FIGS. 3 and 3*a*, respectively.

FIGS. 3 and 3*a* illustrate top plan views of shoulder extensions 20 and 30 that may be used with hanger body 10. FIGS. 3 and 3*a* show the generally curved or rounded top walls 21, 31 of the shoulder extensions. The top walls 21, 31, are integrally formed with downwardly depending, substantially flat, side walls 22 and 23, 32 and 33, respectively. The shoulder extensions 20, 30 are generally U-shaped in cross section and formed to closely fit over and receive a corresponding arm 14, 15 of hanger body 10. As can be seen in FIGS. 3 and 4, the outer contour of shoulder extension 20 is formed by substantially flat, but slightly arched walls 22 and 23 that gradually, arch forward to uniformly merge with the forwardly arched contour of hanger body 10. In this manner, the garment to be supported is presented with a continuous, forwardly arched contour corresponding with the contour of the garment regardless of the shoulder width of the garment.

Figure 4A:
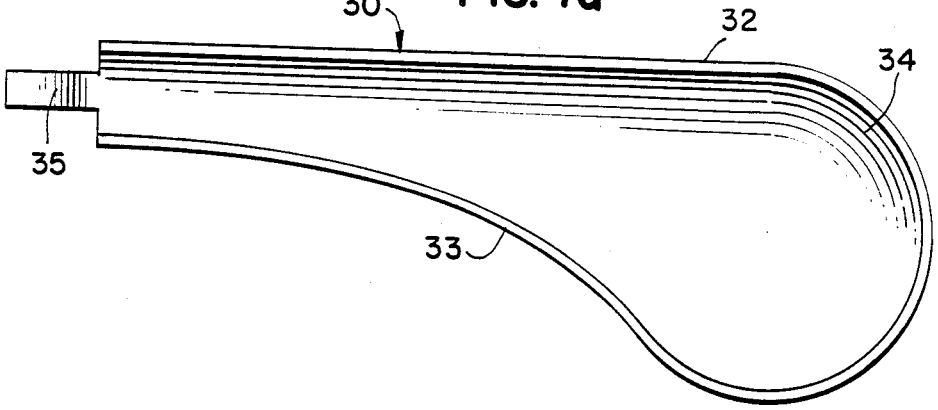

FIGS. 3*a* and 4*a* illustrate the bulbous end portion 34 of shoulder extension 30. Bulbous end portion 34 is adapted to be received within the front shoulder and armhole portion of the garment to be supported by the adjustable garment hanger of the invention. This greatly enhances the support of the armholes and shoulders of the garment when compared to prior adjustable hangers to prevent caving-in and creasing of the garment regardless of the shoulder width of the garment.

Figure 5:
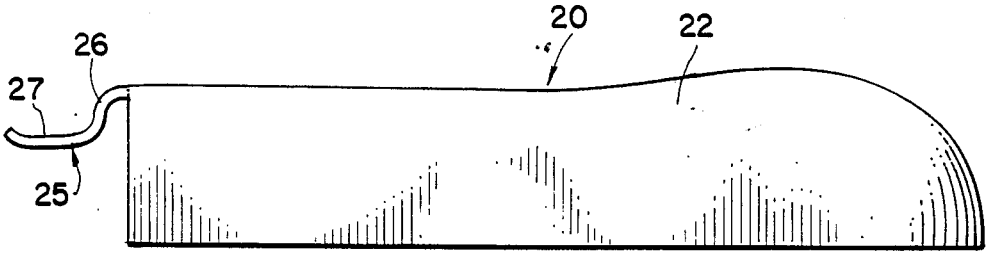
FIGS. 5 and 5*a* are side views of the shoulder extensions shown in FIGS. 3 and 3*a*, respectively.
Figure 5A:
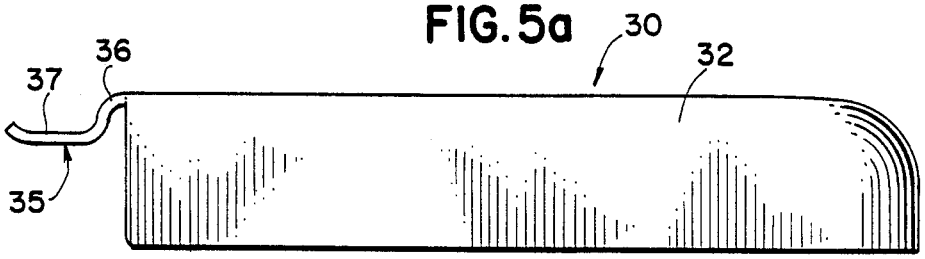

FIGS. 5 and 5*a* illustrate side views of shoulder extensions 20, 30 respectively. Shoulder extensions 20 and 30 are preferably separately molded as individual pieces and each shoulder extension is integrally formed with a respective tongue member 25, 35 as best illustrated in FIGS. 5 and 5*a*. Each tongue member comprises a curved portion 26, 36 and a second substantially flat portion 27, 37 integrally molded with its respective shoulder extension 20, 30. In this manner, the adjustable garment hanger of the invention is formed from three principal parts, namely hanger body 10 and a pair of shoulder extensions 20 or 30.

Figure 6:
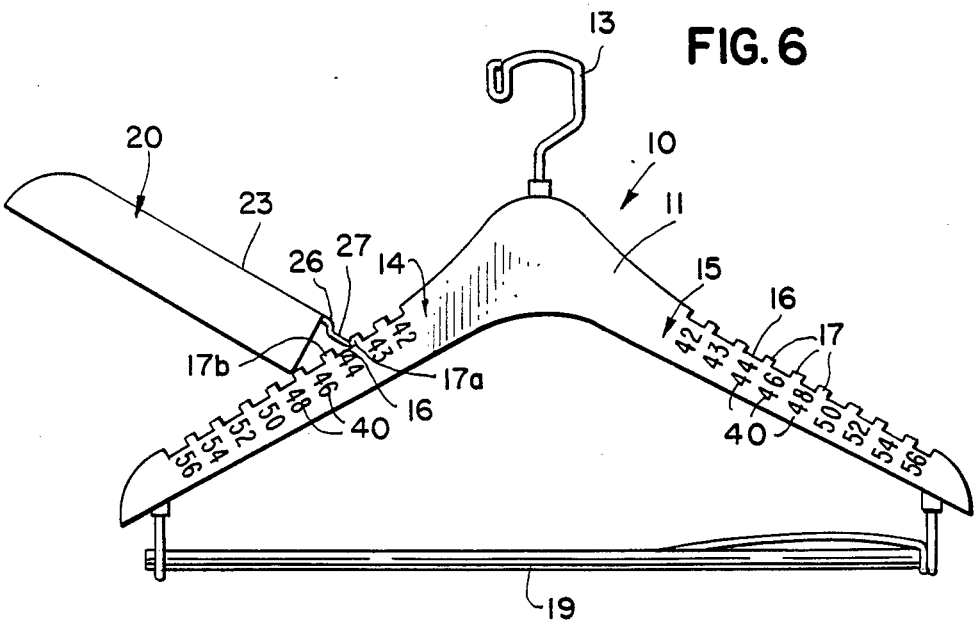
FIG. 6 is front plan view illustrating the detachable connection between a shoulder extension and the hanger body.
Figure 7:
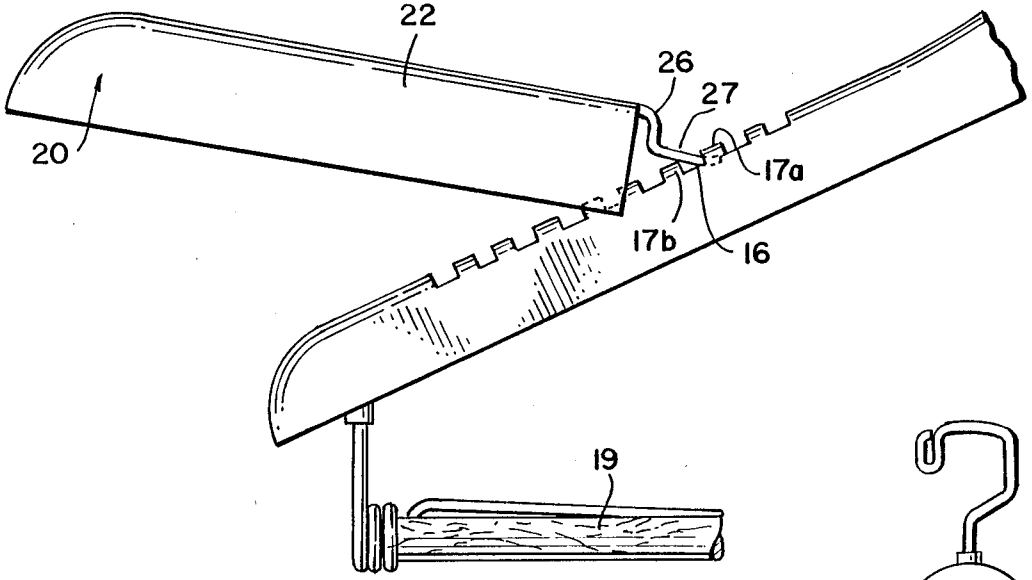
FIG. 7 is a partial, back plan view illustrating the detachable connection between the shoulder extension and the hanger body shown in FIG. 6.

FIG. 6 illustrates the detachable connection between shoulder extension 20 and arm 14 of hanger body 10. It is understood that the shoulder extension 20 for arm 15 is not illustrated in the front view shown in FIG. 6, nor in the back view of the detachable connection shown in FIG. 7. It is also understood that connection of the bulbous shoulder extension 30 is accomplished in the same manner as extension 20. In order to connect shoulder extension 20 to hanger body 10, projecting tongue member 25 is inserted into the hollow cross section of hanger arm 14 via one of the notches 16 such that flat tongue portion 27 is fitted underneath arch 17*a* and curved tongue portion 26 closely fits over adjacent arch 17*b*. As previously discussed, the hollow shoulder extension 20 closely fits around arm 14 and uniformly merges with the outer contour thereof. FIG. 7 illustrates a partial back view of the detachable connection shown in FIG. 6.

Figure 8:
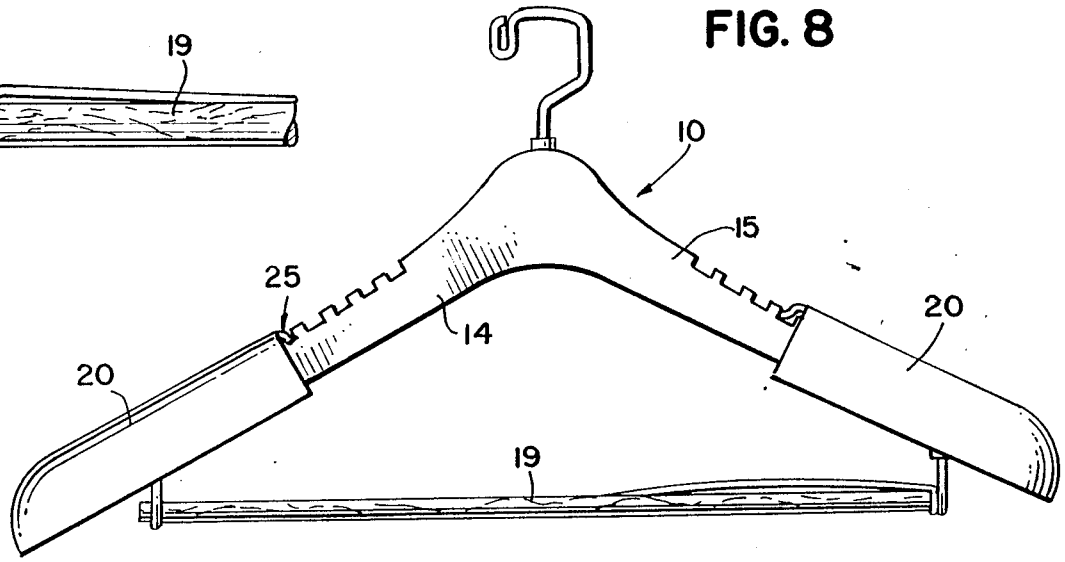
FIG. 8 is a front plan view illustrating the adjustable garment hanger of the invention with a shoulder extension attached to each arm.

In FIG. 8, the adjustable garment hanger of the invention is illustrated with a pair of shoulder extensions 20 removably attached thereto. As best seen in FIG. 1 and FIG. 6 each arm 14, 15 may be provided with indicia 40 associated with each notch 16. Indicia 40 may be integrally molded with hanger body 10 or separately formed and, for example, adhesively connected thereto. The indicia may represent standard jacket sizes such that the adjustable garment hanger may be conveniently adjusted to a predetermined garment size by merely inserting projecting tongue member 25, 35 of extension 20, 30 into the correspondingly labeled notch.

We claim:

1. An adjustable garment hanger comprising:

(a) a hanger body having a central portion and two integrally formed arms depending therefrom, said central portion and arms having forwardly arched contours defining a continuous, forwardly arched contour for the hanger body;

(b) a bore formed in said central portion;

(c) a hook mounted in said bore for supporting the hanger;

(d) a plurality of notches provided in a curved top portion of each arm; and (e) two hollow shoulder extensions having generally U-shaped cross sections with each of said shoulder extensions detachably connected to a respective arm and each of said shoulder extensions having a forwardly arched contour merging with the forwardly arched contour of the hanger body and a longitudinally projecting tongue member extending in a generally parallel direction from a top portion of said shoulder extension, said tongue member detachably retained in one of said notches whereby each shoulder extension closely fits over its respective arm.

2. An adjustable garment hanger according to claim 1 wherein said hanger body and shoulder extensions are molded from plastic as separate integral pieces, with each longitudinally projecting tongue member being integrally formed with its respective shoulder extension.

3. An adjustable garment hanger according to claim 1 wherein each of said arms further comprises two substantially flat, side walls downwardly depending from said curved top portion, said notches being formed as apertures in said curved top portion separated by individual arches spanning said substantially flat, side walls.

4. An adjustable garment hanger according to claim 3 wherein each projecting tongue member comprises a first curved section connected to one of said shoulder extensions and a second substantially straight section attached to said curved section whereby each shoulder extension is detachably connected to its respective arm by inserting said second section into one of said apertures such that said second section lies underneath one of said arches and said first section lies over an adjacent arch.

5. An adjustable garment hanger according to claim 4 wherein each aperture has associated therewith a visible symbol representative of a predetermined garment size whereby said shoulder extensions may be detachably connected to said arms in positions corresponding to predetermined garment sizes.

6. An adjustable garment hanger according to claim 2 wherein each of said shoulder extensions comprises a forwardly projecting, bulbous end portion integrally formed therewith for supporting the shoulder and armhole of an associated garment.

7. An adjustable garment hanger according to claim 3 wherein each of said arms are hollow and comprises a generally U-shaped cross section defined by said curved top portion and said downwardly depending sidewalls.

* * * * *